US006507468B1

(12) United States Patent
Klattenhoff et al.

(10) Patent No.: US 6,507,468 B1
(45) Date of Patent: Jan. 14, 2003

(54) CONTROLLER FOR HEAT ENGINEERING INSTALLATIONS

(75) Inventors: Juergen Klattenhoff, Delmenhorst (DE); Joachim-Christian Politt, Bremen (DE); Guenter Schmitz, Oldenburg (DE)

(73) Assignee: Gestra GmbH, Bremen (DE)

( * ) Notice: Subject to any disclaimer, the term of this patent is extended or adjusted under 35 U.S.C. 154(b) by 163 days.

(21) Appl. No.: 09/604,942

(22) Filed: Jun. 27, 2000

(30) Foreign Application Priority Data

Aug. 28, 1999 (DE) ..... 199 41 022

(51) Int. Cl.[7] ..... H02H 9/00; H01H 9/00
(52) U.S. Cl. ..... 361/54; 361/189
(58) Field of Search ..... 361/54, 191, 166, 361/189; 324/418

(56) References Cited

U.S. PATENT DOCUMENTS 3,863,110 A * 1/1975 Bauer, Jr. ..... 317/13 A
3,910,118 A 10/1975 Schittek et al.
4,054,935 A * 10/1977 Ginsberg ..... 317/135 R
4,127,887 A * 11/1978 Tanaka et al. ..... 361/86
4,841,158 A * 6/1989 Latka ..... 307/10.1
5,287,085 A * 2/1994 Smith ..... 340/438
5,546,002 A * 8/1996 Hickl ..... 324/418
5,594,312 A * 1/1997 Schwendeman ..... 318/799

FOREIGN PATENT DOCUMENTS

DE 25 31 915 1/1977

* cited by examiner

*Primary Examiner*—Brian Sircus
*Assistant Examiner*—Z Kitov
(74) *Attorney, Agent, or Firm*—Collard & Roe, P.C.

(57) ABSTRACT

A controller has two shunt lines connected in parallel with safety relays. For testing their switching capability, the safety relays are reversed to their idle positions and the change in voltage is monitored on their idle contacts. If voltage is missing, an error signal is issued. During the test, the parallel shunt line is closed so that the safety power line is not interrupted. Switching amplifiers having a response and action time which is a fraction of the preset response time of the safety relays control the safety relays. For testing the electrical control, the drives of the safety relays are switched to currentless and the change in voltage is monitored on the drives. If the change in voltage is inadequate, an error signal is issued. The safety relays remain in their operating positions during the test.

15 Claims, 3 Drawing Sheets

1
7
RELAY
CIRCUIT
8
3
4
ELECTRONIC CONTROLLER
2
7
5
35
36
37
6

CONTROLLER FOR HEAT ENGINEERING INSTALLATIONS

BACKGROUND OF THE INVENTION

1. Field of the Invention

The invention relates to a controller for the safety power line of a heat engineering installation as more particularly described herein.

2. The Prior Art

For heat engineering installations, in particular plants for generating steam or hot water, it is desired to operate such installations automatically, i.e. without the continuous presence of operating and supervisory personnel. According to the current regulations, e.g. "Technische Regel für Dampfkessel" ("TRD" 604) [Technical Regulation for Steam Boilers], an operation without continuous supervision requires special devices that reliably prevent dangerous operating conditions from occurring.

For example, fill level limiting devices, which switch off the heating system of the boiler if the fill level falls below a lower limit value, are required in order to prevent overheating of the steam boiler to a degree endangering the safety of the installation. For this purpose, fill level sensors monitor the fill level of the steam boiler for values falling below the limit value. Controllers are connected to the fill level sensors. On the output side, the controllers have two safety relays connected in series. The safety relays are arranged in the safety power line of the heating system of the steam boiler. As long as the lower limit value is exceeded, the controller switches the two safety relays to passage. The safety power line is thus closed and the heating of the steam boiler is released. However, if the value falls below the lower limit value of the fill level, the fill level sensor supplies the controller with another, different signal, whereupon the controller reverses the safety relays and in this way breaks the safety power line. The heating of the steam boiler is then interrupted.

The same type of safety requirement, namely that the safety power line has to be interrupted when a preset limit value is reached, may have to be satisfied also for other physical operating parameters of heat engineering plants. For example, such physical operating parameters include the maximally permissible fill level, the maximally permissible operating pressure, the maximally permissible operating temperature, or the maximally permissible electrical conductivity of the liquid of the boiler.

The safety devices employed for meeting the requirements have to be fail-safe. Sensors and controllers have to be designed for this purpose in the form of self-monitoring equipment. The mechanical part of the sensors as well as the electrical part of the sensors and the switching devices therefore have to be automatically tested at preset time intervals for their functionality. If such tests find that a malfunction exists, the safety power line will become interrupted and thus, for example, the heating system of the steam boiler will shut down. So as to assure that the safety relays employed are fail-safe, their mechanical useful life is therefore expected to satisfy very high requirements, for example 300,000 switching operations.

During a normal operation without malfunctions, the safety relays remain for a very long time in one and the same position. Under certain circumstances, this may cause the contacts of the safety relays to fuse with each other in position. If a malfunction were to occur, the safety relay so affected would not break the safety power line in spite of the corresponding setting signal of the controller. Since two safety relays are connected in series, such a malfunction of one of the relays would not pose a safety risk. However, the malfunction would remain undetected. If the same defect, however, were to occur also in the second safety relay, this would lead to a critical operating condition.

The invention is concerned with the problem of providing a controller of the type specified above whose safety relays are monitored for safety-relevant operating parameters.

SUMMARY OF THE INVENTION

The problem is solved according to the invention by a controller wherein a shunt line is connected in parallel with a first safety relay which connects the safety power line of a heat engineering installation upstream of the first safety relay with a connecting line between two series-connected safety relays for the connection of the safety power line. A shunt line is connected in parallel with the second safety relay which connects the safety power line downstream of the second safety relay with the connecting line between the two safety relays. Test switching elements are provided in the shunt lines which break the shunt lines outside of the scheduled test times. The safety relays are designed in the form of changing relays or change-over switching devices with an idle position and an operating position. Each safety relay has an idle contact, an operating contact, and a base contact, whereby the base contact and the idle contact are electrically connected to each other in the idle position, and the base contact and the operating contact are electrically connected to each other in the operating position.

The controlling device has test means for testing the switching capability of the safety relays at preset test times, wherein the shunt line associated in each case with the safety relay to be tested is closed by way of the test switching elements; the safety relay is reversed to the idle position; the electrical voltage is monitored on the idle contact of the tested safety relay; and an error signal is issued if voltage is missing on the idle contact.

The switching capability of the safety relays is tested by the controller at preset time intervals. The controller tests whether the safety relays, when receiving the corresponding setting signals, reverse from their operating position closing the safety power line, to the idle position breaking the safety power line. The safety power line is in fact interrupted when needed only if this has been safely ascertained. The electrical voltage on the idle contact of the safety relay to be tested supplies information as to whether the safety relay has assumed the idle position. Any non-reversing, and thus a malfunction, is detected and can be eliminated. Since the shunt line of the safety relay to be tested is closed during the test, the safety power line remains closed during this time. The operation of the plant is therefore not interrupted during the test.

Further developments of the invention are discussed below.

If the operating parameter to be monitored reaches its preset limit value, the safety relays are reversed and thereby assume their idle position. In one embodiment, the safety relays are connected to each other at their base contacts, whereas the safety power line is connected to the operating contacts. With these features, no electrically conducting connection then exists between their idle contacts and the safety power line. A reliable interruption of the safety power line is thus assured. No special requirements during the test need be satisfied in monitoring the voltages on the idle contacts of the safety relays.

In another embodiment, two test switching elements are connected in series. The first test switching element is connected to the connecting line of the two safety relays via a common line part of the shunt lines. The second test switching element is designed as a changing relay or change-over switching device and selectively makes a connection between the first test switching element and the shunt line leading to upstream of the first safety relay, or between the first test switching element and the other shunt line leading to downstream of the second safety relay.

This shunt line design ensures that only one of the two shunt lines can be closed, whereas the other line is interrupted. If both safety relays are in the idle position, the safety power line is reliably interrupted. The position of the test switching elements is unimportant in this connection. Errors occurring in connection with the control of the test switching elements, for example due to a defect in the controller, cannot impair the interruption.

In another embodiment, first and second test relays are designed as changing relays or change-over switching devices with an idle position and an operating position and serve as test switching elements. Each test relay has an idle contact, an operating contact and a base contact, whereby the base contact and the idle contact are electrically connected to each other in the idle position, whereas the base contact and the operating contact are electrically connected to each other in the operating position. This arrangement offers the advantage that identical structural components can be used for the safety relays and the test switching elements, which makes it possible to reduce the variety of the components. Structurally simple, commercially available relays can be employed. No special relays are required, for example of the type with additional, forcibly guided safety contacts.

The position of the test relay connected to the connection line of both safety relays is determined with the help of an embodiment in which one test relay is connected with its base contact and its operating contact to the common part of the shunt lines.

During the test of the safety relays, the controlling device first reverses the one test relay from the idle position to the operating position, and monitors the electrical voltage on its idle contact, and issues an error signal if voltage is present.

Any error of the test relay that breaks the shunt lines or switches the lines to passage, is detected. The safety relays are tested when the associated shunt line is switched to passage. This prevents any unintentional breaking of the safety power line during the course of the test.

In another embodiment, upon completion of the test, the controlling device reverses one test relay from the operating position to the idle position. The electrical voltage is monitored on the idle contact of this test relay, and an error signal is issued if voltage is missing. This arrangement increases the fail-safe quality of the controller by testing whether the shunt line is interrupted after testing the safety relays.

In another embodiment, the idle contact of the other test relay is connected to the shunt line leading to upstream of the first safety relay and its operating contact is connected to the shunt line leading to downstream of the second safety relay, whereas its base contact is connected to the first test relay. This particularly advantageous arrangement of the other test relay serves for reversing from the one shunt line to the other.

The safety power line has to be alive for monitoring the position of the safety relays and of the first test switching element via its idle contacts. In another embodiment, in the test of the safety relays, the controlling device monitors the electrical voltage of the safety power line and carries out the test if voltage is present and temporarily suspends the test if voltage is missing. With these features, incorrect position signals are prevented, and the fail-safe quality of the controller is increased. In another embodiment, the voltage of the line part connecting the two test relays is monitored, which is especially advantageous.

As a rule, a substantial difference exists between the electrical voltage of the safety power line and the electrical voltage of the controller, at least within the operational range in which the controller carries out the control and test functions (example: safety power line 230 volts; controller 5 volts). Decoupling and thus safe electrical separation between the safety power line and the control and test range of the controller is accomplished in a simple way with the help of opto-coupling elements as voltage sensors supplying a lower signal voltage suitable for the controller if voltage is present. The opto-coupling elements may be provided for monitoring the voltage of the safety power line or for monitoring the voltage on the idle contacts of the safety relays and of the first test relay.

In another embodiment, each safety relay has an electromechanical drive and a preset response time. Switching amplifiers whose response and action time amounts to a fraction of the response time of the safety relays are provided for controlling the current supply of the drives. The controlling device has a test means testing the electrical control of the safety relays, for which test the switching amplifier of the drive of the safety relay to be tested is reversed at preset test times, and the change in voltage on the drive is monitored. The switching amplifier is reversed again upon expiration of a preset test duration, and an error signal is issued if the change in voltage is inadequate within the duration of the test, whereby the tests last a fraction of the response time of the safety relay.

Testing of the electrical control of the safety relays is the object of this arrangement. What is tested is whether the drives of the safety relays can be switched to the de-energized state. This takes place without having to reverse the safety relays, and break the safety power line for this purpose.

Another embodiment has the feature that the drives of the safety relays are connected to a voltage source with a preset voltage, on the one hand, and to a base potential on the other. A transistor is provided in connection with the base potential as the switching amplifier, the transistor being controlled by the controlling device. During the test, the transistor breaks the connection of the drive to the base potential and the rise in voltage is monitored on the drive, whereby an inadequate rise in the voltage within the duration of the test effects an error signal. A very brief test is made possible by this embodiment which is highly advantageous.

The control and test functions of the controller can be realized in a particularly advantageous manner according to an embodiment where the controlling device has a microprocessor serving as the test means for carrying out the test and for controlling purposes.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF PREFERRED EMBODIMENTS

Figure 1:
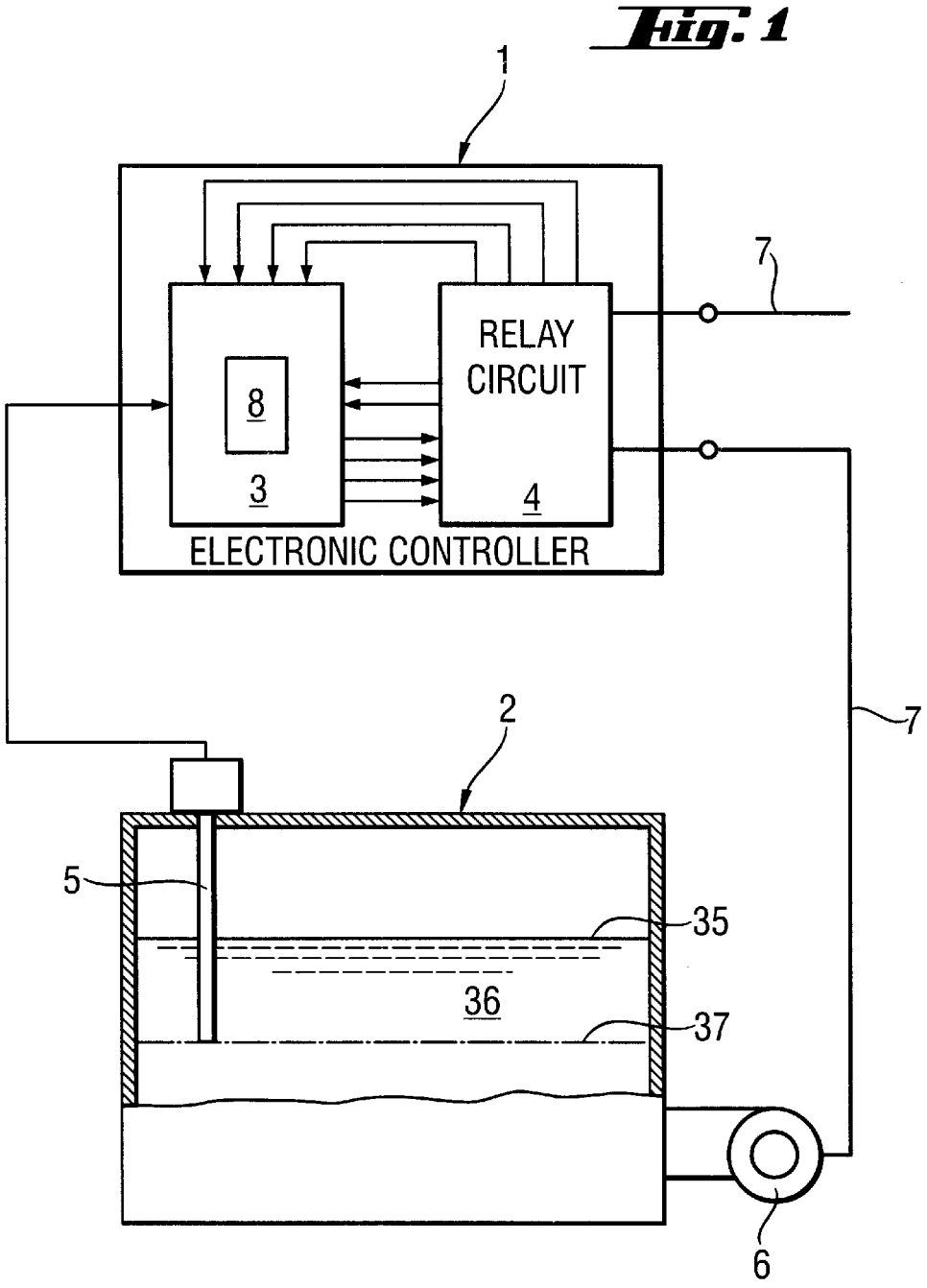
FIG. 1 shows the controller used on a steam boiler.

In FIG. 1, an electronic controller 1 for a steam boiler has a controlling device 3 and a relay circuit 4. The steam boiler 2 is equipped with a fill level sensor 5 and with a burner 6 for heating the boiler. The burner 6 is connected to an electrical safety power line 7, with relay circuit 4 arranged in the line. The fill level sensor 5 supplies its fill level signal to the controlling device 3. The device has a microprocessor 8 for the control and test functions to be carried out.

Figure 2:
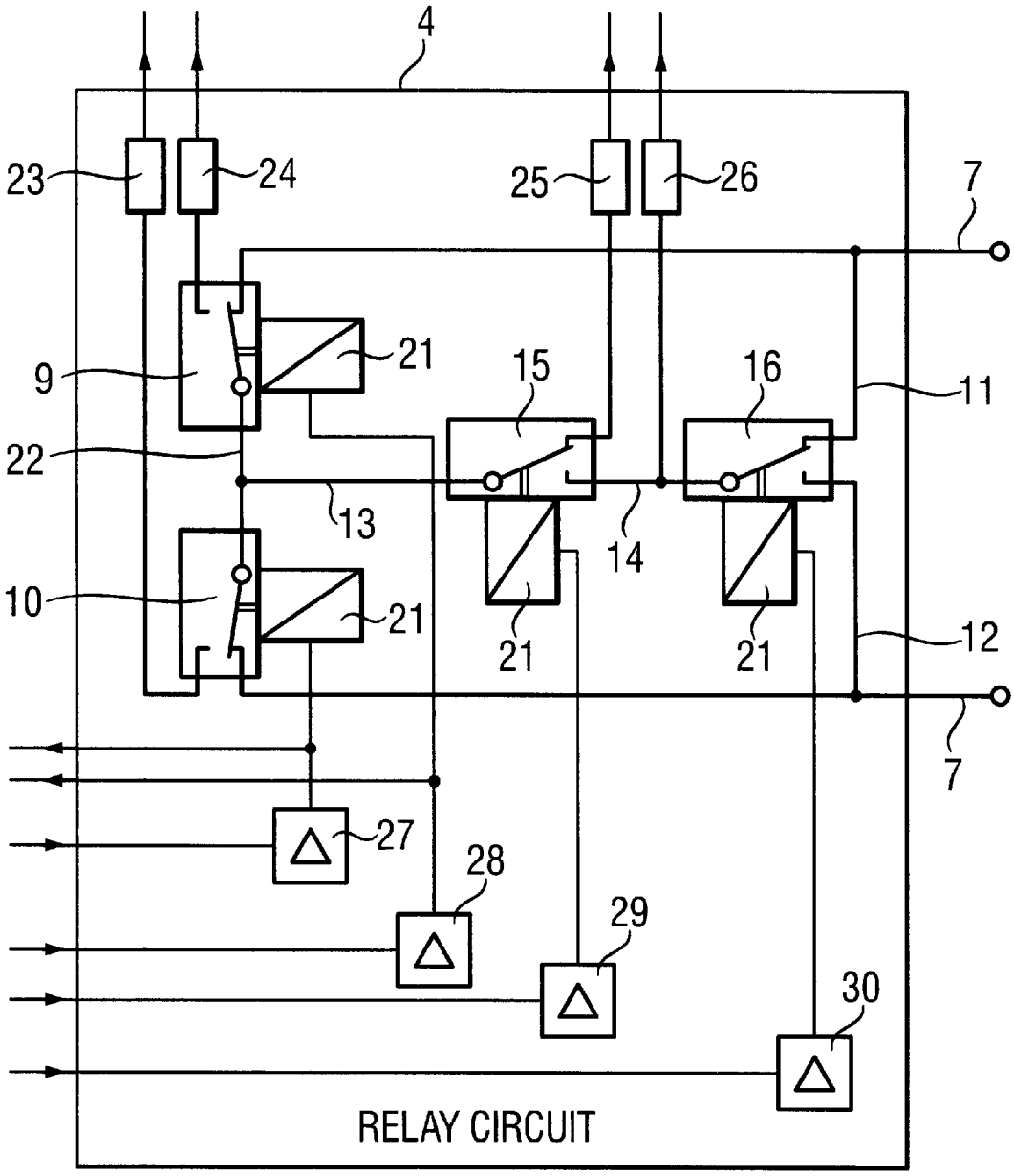
FIG. 2 shows the relay circuit of the controller during normal operation with an adequate fill level in the container.

Relay circuit 4 has two safety relays 9, 10 connected in series in safety power line 7 (FIG. 2). A first shunt line 11 is connected in parallel with first safety relay 9, and a second shunt line 12 is connected in parallel with second safety relay 10. Both shunt lines 11 and 12 have the common line components 13, 14, in which two test relays 15, 16 are connected in series.

Figure 3:
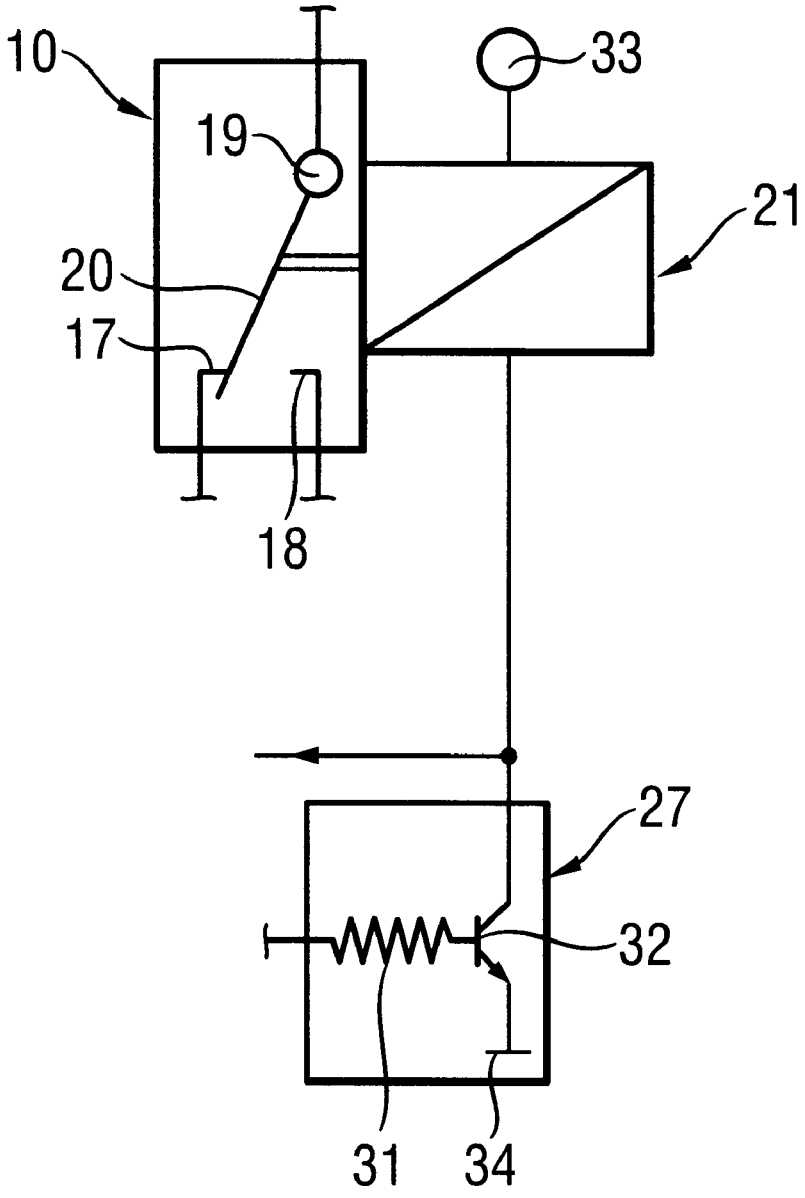
FIG. 3 shows a safety relay of the controller in the idle position, with its switching amplifier.

Both of the two safety relays 9 and 10 and the two test relays 15 and 16 are designed in the form of so-called "changing relays" or "change-over switching devices" with two switching positions: an idle position and an operating position. Each relay 9, 10, 15, 16 has an idle contact 17, an operating contact 18, a base contact 19, a switching element 20, and an electromechanical drive 21 (FIG. 3).

The safety power line 7 is connected to the operating contacts 18 of the two safety relays 9, 10. The base contacts 19 of both safety relays 9, 10 are connected with each other by a connecting line 22. Voltage sensors 23, 24 are connected to the idle contacts 17 of each safety relay 9, 10, and signals to the controlling device the prevailing electrical voltage.

Base contact 19 of first test relay 15 is electrically connected to the connecting line 22 of both safety relays 9, 10 by way of first line part 13. A voltage sensor 25 is connected to the idle contact 17 of test relay 15, the voltage sensor signaling the electrical voltage prevailing there to controlling device 3. Operating contact 18 of test relay 15 is electrically connected to base contact 19 of second test relay 16 via second line part 14. A further voltage sensor 26, connected to controlling device 3, is connected to line part 14 as well. Idle contact 17 of second test relay 16 is connected to safety power line 7 by way of first shunt line 11, namely upstream of first safety relay 9. Operating contact 18 of second test relay 16 is connected to safety power line 7 via second shunt line 12 downstream of second safety relay 10.

If an electrical voltage is applied to idle contacts 17 of the two safety relays 9, 10 or of test relay 15, or to line part 14, this voltage is the voltage of safety power line 7. This voltage is frequently the operating voltage of the general power main, for example 230 volts. Opto-coupling elements, which are provided as voltage sensors 23 to 26, detect this voltage. The opto-coupling elements first convert the applied voltage into a light signal. Based on this light signal, the opto-coupling elements then form an electrical signal with a low voltage suitable for the switching device 3, e.g. of 5 volts. Decoupling takes place in this way, i.e. complete electrical separation between the higher and the lower voltages, which is advantageous for the functional safety.

Finally, relay circuit 4 has switching amplifiers 27, 28, 29, 30 (FIG. 2) with a compensating resistor 31 and a transistor 32 for each of drives 21 of safety relays 9, 10 and of test relays 15, 16 (FIG. 3). A control voltage, for example of 5 volts, is applied to each drive 21 from a suitable voltage source 33. Transistor 32 is controlled by controlling device 3, and depending on the switching signal it receives from controlling device 3, it either makes an electrical connection between the affected drive 21 and a base potential 34, or it breaks such a connection. If the break is adequately long, switching element 20 assumes its idle position in which it connects base contact 19 and idle contact 17 with each other electrically. However, if the connection to base potential 34 exists, current flows through drive 21 and drive 21 switches switching element 20 to the operating position. Base contact 19 and operating contact 18 are then connected to each other electrically.

The fill level 35 of the liquid 36 present in steam boiler 2 has to be monitored during the operation of steam boiler 2 with respect to whether it is below a fixed lower limit value 37. If fill level 35 is above limit value 37, controlling device 3 receives from fill level sensor 5 the fill level signal "fill level adequate". Both safety relays 9, 10 are switched to their operating positions because they are controlled by controlling device 3 accordingly. Safety power line 7 is consequently closed in this way. Burner 6 can heat steam boiler 2 if energy is required.

If fill level 35 in steam boiler 2 falls below limit value 37, fill level sensor 5 transmits to controlling device 3 the fill level signal "lack of liquid". Controlling device 3 in turn controls the safety relays 9, 10 via switching amplifiers 27, 28 and drives 21 of the safety relays so that the safety relays are rendered currentless, whereupon both safety relays 9, 10 assume their idle positions and at the same time break safety power line 7. This reliably prevents heating of steam boiler 2 which, if the fill level falls below lower limit value 37, and there is therefore lack of liquid, could lead to a dangerous operating condition or dry firing of the boiler. Furthermore, the controlling device 3 can transmit a suitable fill level signal.

While the fill level is monitored as described above and thus while controlling device 3 is carrying out its usual control functions, test relay 15 is in its idle position. The two shunt lines 11, 12 are interrupted and no current can flow via the lines.

The function of safety relays 9, 10 is periodically tested by controller 1 in order to assure that safety power line 7 will actually be interrupted if liquid is lacking in steam boiler 2. This involves two different tests which are controlled by microprocessor 8 of controlling device 3. The tests are carried out when fill level 35 is above limit value 37. The tests are suspended if the fill level falls below limit value 37.

One test relates to the electrical control of drives 21 of the two safety relays 9, 10. This test determines whether drives 21 can be switched to a currentless state. Transistors 32 of switching amplifiers 27, 28 receive for this purpose a corresponding control signal from controlling device 3, whereupon transistors 32 break the electrical connection of drives 21 to base potential 34 (FIG. 3). Controlling device 3 monitors in this connection the electrical voltages prevailing on the side of switching amplifiers 27, 28 to drives 21 of safety relays 9, 10. If the interruption to base potential 34 took place flawlessly, the monitored voltages rise to the value of voltage source 33. However, if an error occurs in connection with the control of drives 21 of one or both safety relays 9, 10, and no break takes place, the given monitored voltage is the one of base potential 34. If the expected rise of the voltage fails to occur in the course of the test, controller 1 transmits an error signal accordingly.

Both safety relays 9 and 10 have a preset response time. A certain minimal period of time lapses according to their mechanical switching inertia after drive 21 has been rendered currentless before the affected safety relay 9, 10 would reverse to the idle position. On the other hand, the electrical control processes take place at a substantially higher speed: the response and action times of the processes amount to only a fraction of the response time of safety relays 9, 10. Reversing of transistor 32 and the subsequent voltage rise on drive 21 take place at a fraction of the response time of safety relays 9 and 10. The required test result is already available in controlling device 3 before tested safety relay 9, 10 reverses. Drive 21 of safety relay 9, 10 then immediately receives again from controlling device 3 via switching amplifier 27, 28 the signal to assume the operating condition. The entire test takes only a fraction of the response time of safety relays 9, 10 to be tested. The safety relays therefore remain in the operating positions while they are being tested for their electrical control. Safety power line 7 is consequently not interrupted while the safety relays are being tested.

The second test relates to the mechanical switching capability of safety relays 9 and 10, i.e. the purpose of this test is to determine whether the relays are capable of reversing from their operating positions to their idle positions. The test is carried out only when an electrical voltage is applied to safety power line 7, i.e. when safety power line 7 is alive. This is tested by controlling device 3 via voltage sensor 26. The two safety relays 9 and 10 are tested individually.

To test the first safety relay 9, shunt lines 11, 13, 14, connected in parallel with this relay, are closed first. Test relays 15, 16 are controlled for this purpose by controlling device 3 via switching amplifier 29, 30 so that test relay 16 assumes its idle position, and test relay 15 reverses to the operating position. Shunt lines 11, 13, 14 are then alive all the way through due to the voltage prevailing in safety power line 7. Voltage sensor 26 signals to controlling device 3 the voltage applied. After test relay 15 has been reversed, no electrical voltage is applied to its idle contact 17, which is signaled to controlling device 3 by voltage sensor 25. If this condition has been satisfied by test relay 15, controlling device 3 controls switching amplifier 28 of safety relay 9 so that its drive 21 is rendered currentless. Safety relay 9 thereupon reverses to its idle position and in this position breaks safety power line 7. The voltage of safety power line 7 is then applied to the idle contact 17 of safety relay 9, which is signaled to controlling device 3 via voltage sensor 24. This demonstrates that safety relay 9 is capable of switching.

Thereafter, controlling device 3 switches safety relay 9 to the operating position via switching amplifier 28 and drive 21. After this reversal has taken place, voltage sensor 24 signals to controlling device 3 a voltage drop on idle contact 17. Switching amplifier 29 of test relay 15 then receives the signal for reversing to the idle position. In the idle position, the voltage of safety power line 7 is again applied to idle contact 17 of test relay 15 via line part 13. Via voltage sensor 25, this supplies controlling device 3 with the signal that shunt lines 11, 13, 14 are again interrupted. The test of safety relay 9 is now successfully completed.

To test the second safety relay 10, the other shunt lines 12, 13, 14 are closed. For this test, test relay 16 is reversed to its operating position by controlling device 3 by way of switching amplifier 30 and drive 21. Test relay 15 is reversed to its operating position as well. This process is monitored by controlling device 3 with the help of voltage sensor 25. Analogous to the test of safety relay 9, safety relay 10 receives from controlling device 3 via switching amplifier 27 the signal to reverse to the idle position. After the reversal has taken place, the voltage of safety power line 7 is applied to idle contact 17 of safety relay 10. Controlling device 3 receives from voltage sensor 23 a corresponding signal, which demonstrates the fact that safety relay 10 is capable of switching.

The subsequent reversing of safety relay 10 to the operating position and of test relay 15 to the idle position, combined with monitoring of the positions via voltage sensors 23, 25, corresponds with the procedure described above with respect to safety relay 9. In addition, test relay 16 is reversed to its idle position. This then completes also the test of safety relay 10.

Although safety relays 9, 10 break safety power line 7 during the test, safety power line 7 nonetheless remains closed via parallel shunt line 11, 13, 14, or 12. The function of burner 6 is therefore not disturbed by the test.

If safety relay 9 or 10 to be tested is defective and does not reverse to the idle position in spite of being instructed by controlling device 3 to assume the idle position, the voltage of safety power line 7 will not be applied to its idle contact 17. Controlling device 3 will thereupon issue an error signal accordingly, and will reverse test relay 15 to its idle position.

If, at the start of the test, test relay 15 does not reverse to its operating position in spite of the reversing command it was issued by controlling device 3, the voltage of safety power line 7 will continue to be applied to its idle contact 17. Controlling device 3 will detect this via voltage sensor 25 as an error, discontinue further testing and transmit an error signal accordingly. An error signal will also be produced if, for the completion of the test, test relay 15 does not reverse to the idle position in spite of having received a corresponding reversing command from controlling device 3, i.e. if the voltage of safety power line 7 is not applied again to its idle contact 17.

A switching defect of test relay 16 will not result in any undetected malfunction of controller 1. Such an error will not close the shunt line that is connected in parallel with the safety relay to be tested, but rather will close the other one. In this case, an interruption of safety power line 7 will occur if the relay to be tested is reversed to its idle position. This will interfere with the operation of steam boiler 2; however, no dangerous operating condition can arise. Therefore, the controller will be fail-safe even in the presence of such a defect. The switching capability of test relay 16 can be tested when both safety relays 9, 10 reverse to their idle positions because the fill level falls below limit value 37. In the idle position, the voltage of safety power line 7 is applied to voltage sensor 26—which is connected to line part 14—located upstream of safety relay 9, whereas the voltage is missing when test relay 16 is in its operating position.

If, because of a malfunction of controlling device 3, test relay 15 will be reversed to its operating position outside of the aforementioned tests, and one of the two shunt lines 11, 13, 14, or 12, 13, 14 will thus be closed and no safety risk would ensue. If the fill level falls below limit value 37, fill level sensor 5 transmits a corresponding fill level signal to controlling device 3, which thereupon reverses both safety relays 9, 10 to their idle positions, which will reliably break safety power line 7. The closed shunt lines 11, 13, 14, or 12, 13, 14, respectively, will not change this process in any way.

Even though controller 1 has been described above specifically in connection with the monitoring of the lower limit value of the fill level of a steam boiler, controller 1 nonetheless can be employed also for monitoring the other physical operating parameters of steam boilers and other heat engineering installations as mentioned in the introductory part of the present description.

While several embodiments of the present invention have been shown and described, it will be obvious that many changes and modifications may be made thereunto without departing from the spirit and scope of the invention.

What is claimed is:

1. A controller for connection to a sensor monitoring a safety-relevant physical operating parameter of a heat engineering installation for interrupting a safety power line of the installation, which comprises;

(a) first and second series-connected safety relays connected by a connecting line and adapted to switch between an uninterrupted state and an interrupted state of the safety power line, said safety relays comprising change-over switching devices having an idle position and an operating position, each safety relay comprising an idle contact, an operating contact and a base contact, said base contact and said idle contact being electrically connected to each other in the idle position, said base contact and said operating contact being electrically connected to each other in the operating position, wherein the safety relays are connected to each other at their base contacts and the safety power line is connected to the operating contacts;

(b) a first shunt line electrically connecting the safety power line upstream of the first safety relay with the connecting line between the safety relays when said first shunt line is in an uninterrupted state;

(c) a second shunt line electrically connecting the safety power line downstream of the second safety relay with the connecting line between the safety relays when said second shunt line is in an uninterrupted state;

(d) a plurality of test switching elements provided in the shunt lines, said test switching elements breaking the shunt lines outside of preset test times; and (e) a controlling device to be connected to the sensor and the safety relays, said controlling device switching said safety relays in dependence on a signal of the sensor so that the safety power line is interrupted when a limit value of the operating parameter is reached, said controlling device comprising test means testing the switching capability of the safety relays at preset test times by closing the shunt line associated with the safety relay to be tested by the test switching elements, reversing the safety relay to be tested to the idle position, monitoring the electrical voltage of the idle contact of the tested safety relay and issuing an error signal if voltage is missing on the idle contact of the tested safety relay.

2. The controller according to claim 1, wherein:

(a) first and second test switching elements are connected in series;

(b) the shunt lines have a common line part and the first test switching element is connected to the connecting line of the safety relays via the common line part; and (c) the second test switching element comprises a change-over switching device and selectively makes a connection between the first test switching element and the first shunt line leading to upstream of the first safety relay, or between the first test switching element and the second shunt line leading to downstream of the second safety relay.

3. The controller according to claim 2, wherein:

(a) the test switching elements comprise first and second test relays designed as change-over switching devices having an idle position and an operating position; and (b) each test relay comprises an idle contact, an operating contact and a base contact, said base contact and said idle contact being electrically connected to each other in the idle position, said base contact and said operating contact being electrically connected to each other in the operating position, wherein the operating contact of the first test relay is connected to the base contact of the second test relay.

4. The controller according to claim 3, wherein:

(a) the shunt lines have common line parts and the first test relay is connected with its base contact and its operating contact to the common line parts; and (b) during the test of the safety relays, the controlling device first reverses the first test relay from the idle position to the operating position and monitors the electrical voltage on its idle contact and issues an error signal if voltage is present.

5. The controller according to claim 4, wherein upon completion of the test, the controlling device reverses the first test relay from the operating position to the idle position; monitors the electrical voltage on the idle contact of the first test relay and issues an error signal if voltage is missing.

6. The controller according to claim 3, wherein the idle contact of the second test relay is connected to the first shunt line leading to upstream of the first safety relay and its operating contact is connected to the second shunt line leading to downstream of the second safety relay, the base contact of said second test relay being connected to the first test relay.

7. The controller according to claim 1, wherein in testing the safety relays, the controlling device monitors the electrical voltage of the safety power line and carries out the test if voltage is present and temporarily suspends the test if voltage is missing.

8. The controller according to claim 7, wherein the electrical voltage of the safety power line is monitored once at the start of the test of the safety relays.

9. The controller according to claim 3, wherein the test relays are connected by a common line part of the shunt lines and the voltage of the common line part connected to the test relays is monitored.

10. The controller according to claim 1, further comprising opto-coupling elements as voltage sensors for monitoring the voltage of the safety power line, said elements supplying a lower signal voltage of a quantity suitable for the controlling device if voltage is present in the safety power line.

11. The controller according to claim 3, further comprising opto-coupling elements as voltage sensors for monitoring the voltage on the idle contacts of the safety relays and of the first test relay, said elements supplying a lower signal voltage of a quantity suitable for the controlling device if voltage is present in the safety power line.

12. The controller according to claim 1 wherein:

(a) each safety relay has an electromechanical drive and a preset response time;

(b) the controller further comprises a plurality of switching amplifiers connected to and controlling the current supply of the drives, said amplifiers having a response and action time amounting to a fraction of the response time of the safety relays; and (c) said test means tests electrical control of the safety relays by reversing at preset test times the switching amplifier of the drive of the safety relay to be tested and monitoring the change in voltage on the drive of the tested safety relay, reversing the switching amplifier of the drive of the tested safety relay again upon expiration of a preset test duration, and issuing an error signal if the change in voltage is considered below a selected value within the duration of the test, the test lasting a fraction of the response time of the tested safety relay.

13. The controller according to claim 12, wherein:

(a) the drives of the safety relays are connected to a voltage source with a preset voltage and to a base potential;

(b) the switching amplifier is arranged in the connection with the base potential and comprises a transistor controlled by the controlling device; and (c) for the duration of the test, the transistor breaks the connection of the drive to the base potential and the rise in voltage is monitored on the drive, whereby an inadequate rise in the voltage within the duration of the test effects an error signal.

14. The controller according to claim 1, wherein the controlling device comprises a microprocessor serving as the test means for carrying out the test and for controlling purposes.

15. A controller for connection to a sensor monitoring a safety-relevant physical operating parameter of a heat engineering installation for interrupting a safety power line of the installation, which comprises:

(a) first and second safety relays connected by a connecting line, said safety relays comprising change-over switching devices having an idle position and an operating position, each safety relay comprising an idle contact, an operating contact and a base contact, said base contact and said idle contact being electrically connected to each other in the idle position, said base contact and said operating contact being electrically connected to each other in the operating position, wherein the safety relays are connected to each other at their base contacts and the safety power line is connected to the operating contacts;

(b) a first shunt line electrically connecting the safety power line upstream of the first safety relay with the connecting line between the safety relays when said first shunt line is in an uninterrupted state;

(c) a second shunt line electrically connecting the safety power line downstream of the second safety relay with the connecting line between the safety relays when said second shunt line is in an uninterrupted state;

(d) a plurality of test switching elements provided in the shunt lines, said test switching elements breaking the shunt lines outside of preset test times; and (e) a controlling device to be connected to the sensor and the safety relays comprising test means testing the switching capability of the safety relays at preset test times by closing the shunt line associated with the safety relay to be tested by the test switching elements, reversing the safety relay to be tested to the idle position, monitoring the electrical voltage of the idle contact of the tested safety relay and issuing an error signal if voltage is missing on the idle contact of the tested safety relay.

* * * * *